US012085358B1

(12) United States Patent
Sisk

(10) Patent No.: US 12,085,358 B1
(45) Date of Patent: Sep. 10, 2024

(54) THREADED COLLAR REPOSITIONABLE RAILS FOR AR RIFLE AND HANDGUARD

(71) Applicant: Charles Sisk, Willis, TX (US)

(72) Inventor: Charles Sisk, Willis, TX (US)

( * ) Notice: Subject to any disclaimer, the term of this patent is extended or adjusted under 35 U.S.C. 154(b) by 45 days.

(21) Appl. No.: 17/685,020

(22) Filed: Mar. 2, 2022

Related U.S. Application Data

(60) Provisional application No. 63/156,405, filed on Mar. 4, 2021.

(51) Int. Cl.
*F41A 23/14* (2006.01)
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/04; F41C 23/14; F41C 23/20; F41C 27/06; F41A 3/84; F41A 11/02; F41A 3/66; F41A 11/04; F41A 19/10; F41A 3/26; F41A 35/06; F41B 7/08
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 426,916 A * 4/1890 Cash et al. ..... F41A 3/58 42/74
698,107 A * 4/1902 DeKnight ..... F41A 19/31 89/193
8,230,633 B1 * 7/2012 Sisk ..... F41C 23/06 42/75.01
8,677,669 B1 * 3/2014 Vesligaj ..... F41C 23/12 42/75.01
8,720,099 B1 * 5/2014 Sisk ..... F41C 23/14 42/73
9,574,840 B1 * 2/2017 Sisk ..... F41C 23/16
9,726,444 B1 * 8/2017 Sisk ..... F41A 3/66
10,323,891 B1 * 6/2019 Zheng ..... F41A 3/88
2012/0125189 A1 * 5/2012 McLean, III ..... G06Q 10/08 42/106
2013/0319217 A1 * 12/2013 Gangl ..... F41A 3/84 89/198
2016/0202016 A1 * 7/2016 Mather ..... F41C 23/14 42/73
2017/0328672 A1 * 11/2017 Hewes ..... F41C 23/14
2018/0224227 A1 * 8/2018 Durham, III ..... F41A 3/26
2018/0274870 A1 * 9/2018 Law ..... F41A 3/82
2019/0383572 A1 * 12/2019 Gregorich ..... F41A 15/14
2020/0158451 A1 * 5/2020 Law ..... F41A 3/82
2021/0003357 A1 * 1/2021 Durham, III ..... F41A 3/70
(Continued)

*Primary Examiner* — Michael D David
(74) *Attorney, Agent, or Firm* — Gary K. Price

(57) ABSTRACT

An adjustable AR type buttstock assembly is taught that incorporates a buffer tube with internal threads for attachment to the frame of an AR action. A U-shaped cheek piece, with opposed extending legs is adjustably attached to the buffer tube permitting a shooter's cheek to be in a comfortable position when sighting the firearm. The cheek piece is adjustably attached with at least one threaded fastener that extends through the legs to secure it to the buffer tube. A spacing member is positioned between the opposed cheek piece legs to maintain constant tension between the buffer tube and cheek piece. A butt plate assembly is adjustably disposed into the buffer tube, providing overall buttstock length adjustment, the cheek piece position and butt plate assembly orientation.

8 Claims, 3 Drawing Sheets

(56) References Cited

U.S. PATENT DOCUMENTS

| | | | | |
|---|---|---|---|---|
| 2021/0018296 | A1* | 1/2021 | Faifer | F41C 23/04 |
| 2021/0156633 | A1* | 5/2021 | Durham, III | F41A 3/26 |
| 2022/0252367 | A1* | 8/2022 | Robinson | F41A 9/70 |
| 2023/0296336 | A1* | 9/2023 | Puha | F41A 3/66 89/198 |

* cited by examiner

THREADED COLLAR REPOSITIONABLE RAILS FOR AR RIFLE AND HANDGUARD

CROSS REFERENCES TO RELATED APPLICATIONS

U.S. Provisional Application for Patent No. 63/156,405, filed Mar. 4, 2021, with title "AR Type Buttstock Assembly" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention

This present invention relates to buttstocks in general. More specifically, to a buttstock assembly for replacement in an AR type firearm.

2. Background Information

In 1964 the Colts Manufacturing Company produced a civilian version of the military model M-16 rifle and marketed a semi-automatic rifle and carbine trademarked with the name AR-15. Since then that type of firearm has become so popular that numerous companies not only produce the entire firearm but also individual components. This industry has allowed a person to assemble the selected components personally for cost saving or improvements in appearance, accessories and function.

One of the areas that have been extensively affected is the stock assembly which must include a buffer tube, a cheek resting surface and a butt plate. In most cases the components are of a polymer material and are complex and limited in adjustment. Accordingly, a primary objective of the present invention is to simplify a buttstock by utilizing only five essential elements, a buffer tube, a cheek piece, a spacer or mounting block, a butt plate and a threaded rod between the tube and the butt plate, all of which may be fabricated independently and easily.

SUMMARY OF THE INVENTION

A buttstock assembly for replacement in an AR type firearm is disclosed. Probably the most important aspect of the invention is the fact that the components are both inexpensive and affordable to produce. The numerous buttstock assemblies that are presently on the market today are much more complicated and detailed requiring dedicated tooling along with the requirement to employ injection molding machines.

Another attribute of the present invention is the strength and ruggedness feature by utilizing an aluminum buffered tube which has the same structural characteristics as the firearm.

Still another feature of the invention is the ease of adjustment without special tools. The cheek piece is adjusted upward at parallel with the buffer tube or slanted forward or aft by simply loosening the attachment tension with the two hand knobs that retain the cheek piece. Further, the cheek piece may be relocated angularly to limitedly provide a so-called cast on or cast off position of the buttstock. The butt plate may be adjusted to lengthen or shorten the length of pull by rotating the threaded rod after loosening the retaining nut using a conventional implement, such as a nail or cylindrical rod, placed in one of the holes in the edge of the retaining nut. The butt plate's tilt may be adjusted by reversing the threaded rod ends that attach the tube to the butt plate from either a 90 to 88 degrees angle. The butt plate may be adjusted up or down by repositioning the four cap screws attaching the butt plate to the end of the threaded rod.

Yet another feature of the present invention relates to ease of production as the buffer tube is a standard tube that requires only threads on both ends. The cheek piece is fabricated of sheet of polymer resin using a steel rule die to form the shape and then bent into U-shape when heated. The butt plate is easily machined as well as is the mounting block. The spanning spacer is simply a section of a hollow tube cut to the proper length.

A further aspect of the invention is that it could be used on rifle, carbine, or shotgun having a standard AR type interface thread on the firearm frame.

A final attribute of invention is that the buttstock assembly is uncomplicated, clean and has a simple minimal appearance.

These and other objects and advantages of the present invention will become apparent from the subsequent detailed description of the preferred and second embodiment and the appended claims taken in conjunction with the accompanying drawings.

DESCRIPTION OF THE PREFERRED EMBODIMENTS

Figure 1:
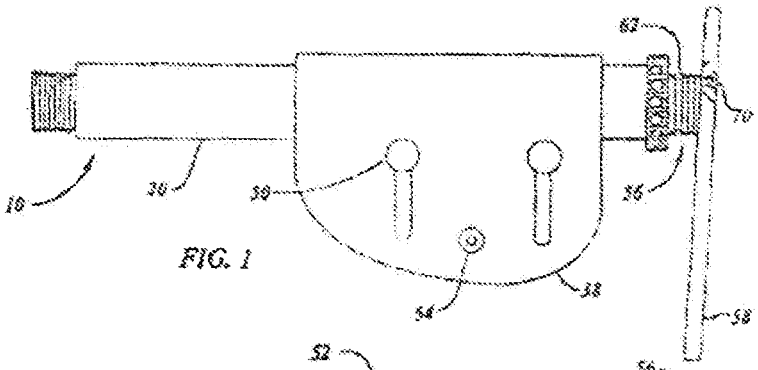
FIG. 1 is a front elevation view of the preferred embodiment.

In accordance with the present invention, a buttstock assembly for replacement in an AR type firearm is disclosed. The disclosed buttstock assembly is directed to an assembly having components that are both inexpensive and affordable to produce, having strength and ruggedness features by utilizing an aluminum buffer tube which has the same structural characteristics as the firearm. In the broadest context, the buttstock assembly of the present invention consists of components configured and correlated with respect to each other so as to attain the desired objective.

The best mode for carrying out the present invention is presented in terms of a preferred and second embodiment. The preferred embodiment is shown in FIGS. 1-21 and is comprised of an adjustable AR type buttstock assembly (10) wherein a buffer tube (20) is attached to an AR type firearm that incorporates internal threads integral with its frame action.

The buffer tube (20) has a first end (22) and second end (24) with the first end (22) having external threads (26) of a configuration compatible with an AR type firearm. The second end (24) has internal threads (28) of a configuration compatible with a butt plate assembly. The buffer tube (20) contains a threaded recoil buffer disc (30) having disc threads (32) on the edges that interface with second end (24) internal threads (28).

The buffer disc (30) has a tool slot (34) for receiving a conventional screwdriver when initially attached. The buffer tube is constructed of a material, preferably aluminum, however a polymer resin or injection molded thermoplastic will also function satisfactorily.

Figure 2:
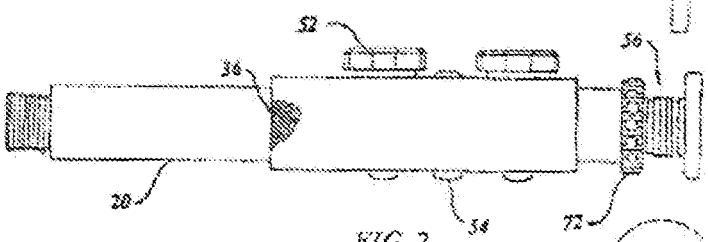
FIG. 2 is a top view of the preferred embodiment.
Figure 3:
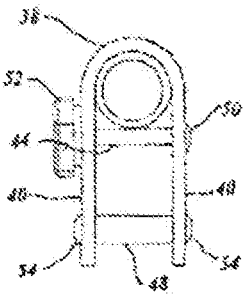
FIG. 3 is a left view of the preferred embodiment.

A knurled portion (36) on the buffer tube (20), illustrated cut away in FIG. 2, is positioned where contact is made with a cheek piece (38) when adjustments are accomplished.

The U-shaped cheek piece (38) has opposed extending legs (40) that are attached to the buffer tube (20) in an adjustable manner permitting a user to rest his or her cheek in a comfortable position when sighting a firearm.

The cheek piece (38) incorporates at least one slot (42), preferably two, on each extending leg (40) to received threaded fasteners (44). The cheek piece (38) utilizes a clearance hole (46) in each extending leg (40) to accommodate a spacer. The threaded fastener (44) extends through the opposed extending legs (40) for gripping the buffer tube (20) rigidly. The threaded fastener (44) is a carriage bolt (50) with a fluted hand knob (52) providing manual positioning of the cheek piece (38) parallel, upward or tilted upward relative to the buffer tube (20) and longitude angularly providing limited cast on and castoff features. The cheek piece (38) is constructed of material preferably a polymer resin or injection molded thermoplastic.

Figure 4:
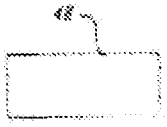
FIG. 4 is a side view of the standoff spacer in the preferred embodiment.
Figure 5:
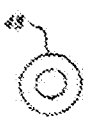
FIG. 5 is an end view of the standoff spacer in the preferred embodiment.
Figure 6:
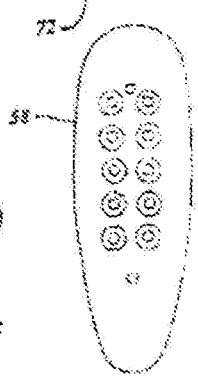
FIG. 6 is a right end view of the butt plate in the preferred embodiment.
Figure 7:
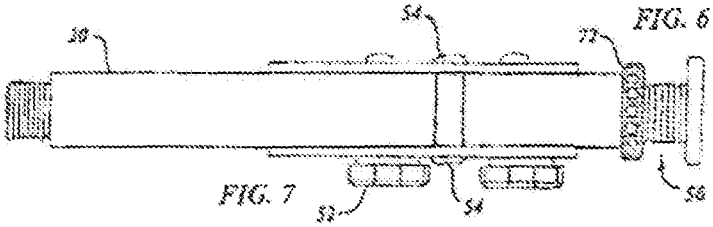
FIG. 7 is a bottom view of the preferred embodiment.

A spanning spacer (48) is disposed between the opposed extending legs (40) of the cheek piece (38) to maintain constant tension between the buffer tube (20) and the cheek piece (38). The standing space (48) illustrated in FIGS. 4 and 5 is internally threaded and has on overall length consistent with buffer tube (20) diameter. The spanning spacer (48) is retained with button head socket screws (54) positioned on an outside surface of each cheek piece extending leg (40). The spanning spacer (48) is constructed of a material such as aluminum, a polymer resin, injection molded thermoplastic or nylon.

Figures 8, 9, 10, 11, 12, 13, 14, 15, 16, 17, 18, 19, 20, 21:
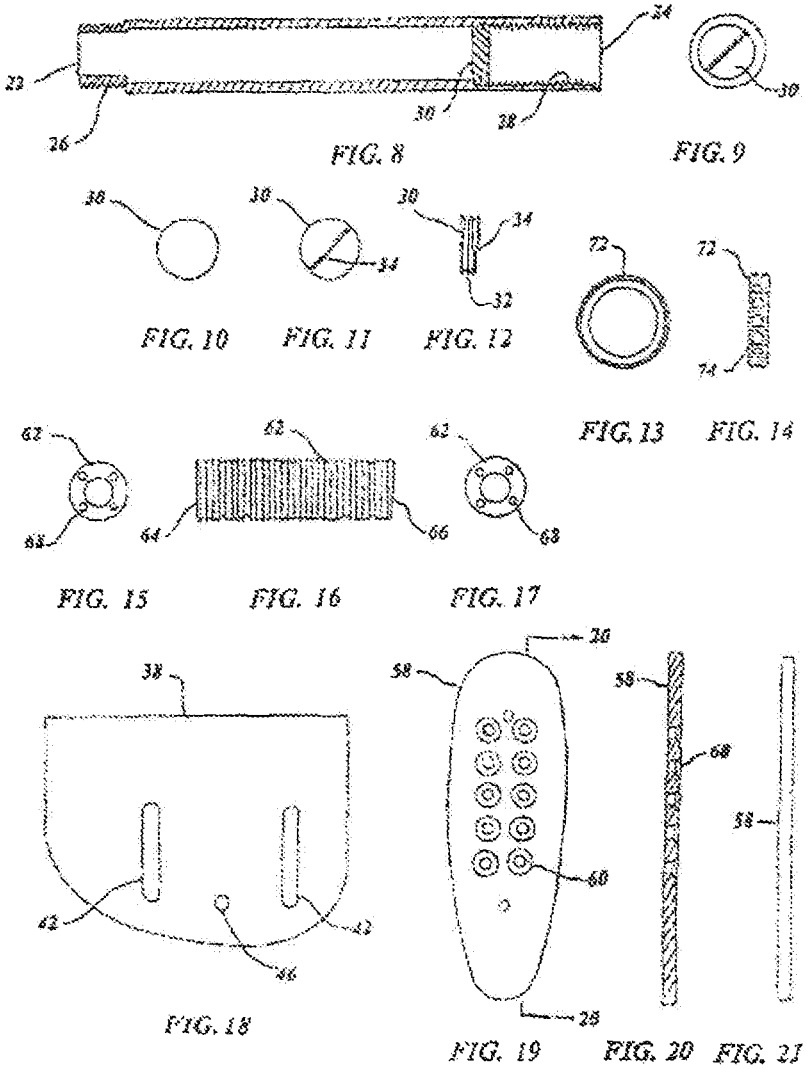
FIG. 8 is a cross sectional view of the buffer tube with the buffer disc positioned inside in both the preferred and second embodiments.
FIG. 9 is a right end view of the buffer tube in both embodiments.
FIG. 10 is a front view of the buffer disc in both embodiments.
FIG. 11 is a rear view of the buffer disc in both embodiments.
FIG. 12 is a side view of the buffer disc in both embodiments.
FIG. 13 is a front view of the retaining nut in both embodiments.
FIG. 14 is an end view of the retaining nut in both embodiments.
FIG. 15 is a left end view of the threaded rod in both embodiments.
FIG. 16 is a front elevation view of the threaded rod in both embodiments.
FIG. 17 is a right end view of the threaded rod in both embodiments.
FIG. 18 is a side elevation view of the cheek piece in both embodiments.
FIG. 19 is a front elevation of the butt plate in both embodiments.
FIG. 20 is a cross sectional view taken along lines 20-20 of FIG. 19.
FIG. 21 is side view of the butt plate in both embodiments.
Figure 22:
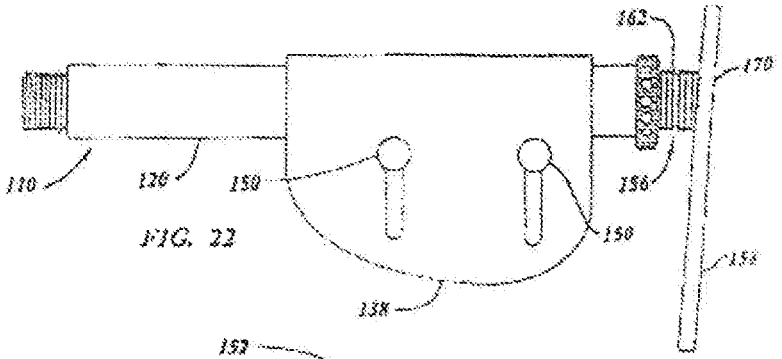
FIG. 22 is a front elevation view of the second embodiment.
Figure 23:
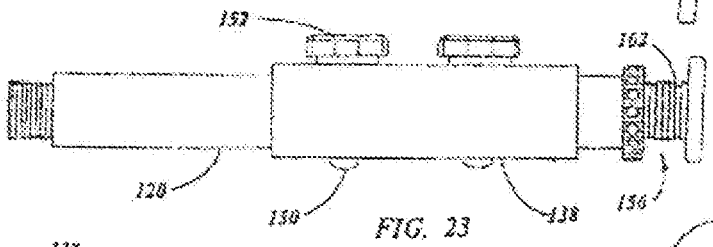
FIG. 23 is a top view of the second embodiment.
Figure 24:
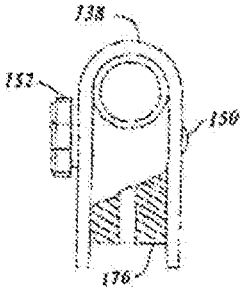
FIG. 24 is a left side view of the second embodiment.

A butt plate assembly (56) is utilized which consists of a plate (58) with a number of attaching countersunk bores (60) which are depicted in FIG. 20. The plate (58) material is preferably aluminum however a polymer resin or an injection molded thermoplastic may also be employed.

A threaded rod (62) has a first end (64) and a second end (66) with the first end (64) vertically flat and the second end (66) angled from 3 degrees to 1 degree, each end having a number of threaded holes (68) for mating with the countersunk bores (60) of the plate (58). This arrangement permits the rod (62) to be either positioned within the buffer tube (20) flat or angled relative to the plate (58). The threaded rod (62) may have every third thread spaced apart to indicate a repeatable depth adjustment.

The butt plate (58) is attached to a selected end of the threaded rod (62) with the flat head cap screws (70) through the countersunk holes (60). A retaining nut (72), shown in FIGS. 13 and 14, lock the threaded rod (62) to the buffer tube (20). The retaining nut (72) has plurality of round cavities (74) on an outside surface for tightening with a spanner.

When the butt plate assembly (56) is attached into the buffer tube (20) along with the retaining nuts (72) the overall buttstock length may be adjusted also the butt plate orientation in angle and position may be established.

The second embodiment of the present invention is illustrated in FIGS. 8-28, and consists of an adjustable AR buttstock assembly (110) where in a buffer tube (120) is attached to an AR type firearm that incorporates internal threads integral with its frame of the action. As will be described, the second embodiment replaces the spinning spacer (48) with a mounting block (176). The remainder of adjustable AR type buttstock assembly (10) is duplicated.

The buffer tube (120) has a first end and a second end with the first end having external threads of a configuration compatible with any AR type firearm.

The second end has internal threads of a configuration compatible with a butt plate assembly. The buffer tube (120) contains a threaded recoil buffer disc having disc threads on the edges that interface with the second end internal threads. The buffer disc has a tool slot for receiving a conventional screwdriver for its initial attachment. The buffer tube (120) is constructed of material preferably aluminum, having a polymer resin or/and injection molded thermoplastic will function satisfactorily.

A U-shaped cheek piece (138) has opposed extending legs that are attached to the buffer tube (120) in an adjustable manner permitting a user to rest his or her cheek in a comfortable position when sighting a firearm.

The cheek piece (138) incorporates at least one slot, preferably two, on each extending leg to receive threaded fasteners. The threaded fasteners extend through the opposed extending legs for gripping the buffer tube (120)

rigidly. The threaded fastener is a carriage bolt (150) and a fluted hand knob (152) providing manual positioning of the cheek piece (138) parallel, upward or tilted, relative to the buffer tube (120) and longitude angularly provided limited cast on and castoff features. The cheek piece (138) is constructed of material preferably a polymer resin or injection molded thermoplastic.

Figure 25:
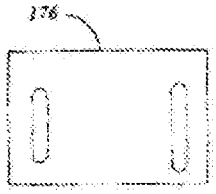
FIG. 25 is a side elevation view of the mounting block in the second embodiment.
Figure 26:
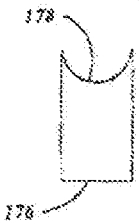
FIG. 26 is a right side elevation view of the mounting block in the second embodiment.

A mounting block (176), illustrated in FIGS. 25 and 26, has radial top (178) and width compatible with a span between the extending leg slots and the same diameter as the buffer tube (120) permitting a rigid attachment to the buffer tube (120). The mounting block (176) is retained with a button head socket set screw (154) depicted in FIG. 28. The mounting block (176) is constructed of a material such as aluminum, a polymer resin, injected molded thermoplastic or nylon.

Figure 27:
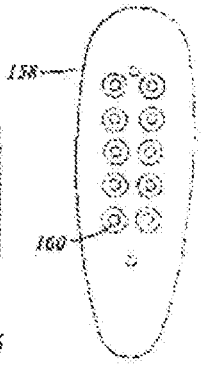
FIG. 27 is a right side view of the butt plate in the second embodiment.
Figure 28:
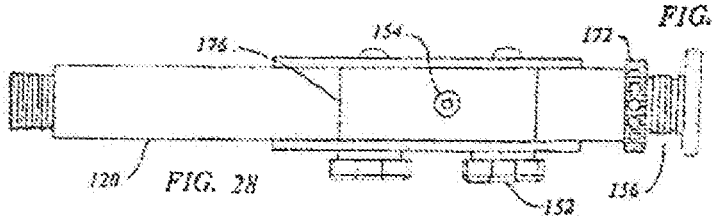
FIG. 28 is a bottom view of the second embodiment.

A butt plate assembly (156) is utilized which consists of a plate (158) with a number of attaching countersunk bores (160) which are depicted in FIG. 27. The plate (158) material is preferably aluminum, however, a polymer resin, or an injection molded thermoplastic may also be employed.

A threaded rod (162) having a first end and a second end with the first end flat and the second end angled from 3 degrees to 1 degree, each having a number of threaded holes, for mating with the countersunk bores (160) of the plate (158). This arrangement permits the rod (162) to be either positioned within the buffer tube (120) flat or angled relative to the plate (158). The threaded rod (162) may have every third thread spaced apart to indicate a repeatable depth adjustment.

The butt plate (158) is attached to a selected end of the threaded rod (162) with flat head cap screws (170) through the countersunk holes (160). A retaining nut (172), shown in FIG. 28, locks the threaded rod (162) to the buffer tube (120). The retaining nut (172) has a plurality of round cavities on an outside surface for tightening with a spanner.

When the butt plate assembly (156) is attached in to the buffer tube (120) along with retaining nut (172) the overall buttstock link may be adjusted. Also, the butt plate orientation in angle and position may be established.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

As such, it will be obvious to those skilled in the art that modifications may be made to the embodiments described above without departing from the scope of the invention. Thus, the scope of the invention should be determined by the claims in the formal application and their legal equivalents, rather than by the examples given.

I claim:

1. An AR buttstock assembly comprising:

a buffer tube having a first end and a second end with the first end having external threads of a configuration compatible with an AR type firearm, and the second end having internal threads of a configuration compatible with a butt plate assembly, said buffer tube including a threaded recoil buffer disc that defines edges and having disc threads on the edges that interface with the second end internal threads, said buffer disc further defining a tool slot for receiving a conventional screwdriver, said buffer tube further defining a knurled portion positioned where contact is made with a U-shaped cheek piece, wherein said U-shaped cheek piece having opposed extending legs that are attached to the buffer tube in an adjustable manner permitting a user to rest its cheek in a comfortable position when sighting a firearm, said cheek piece incorporates at least one slot on each extending leg to receive at least one threaded fastener, and utilizes a clearance hole in each extending leg to accommodate a spacer such that the threaded fastener extends through the opposed extending legs for gripping the buffer tube rigidly, said threaded fastener includes a hand knob providing manual positioning of the cheek piece parallel, upward or tilted relative to the buffer tube and a longitude angularly providing limited cast on and cast off features, a spanning spacer is disposed between the opposed extending legs of the cheek piece to maintain constant tension between the buffer tube and the cheek piece, said spanning spacer is internally threaded and has a length consistent with the buffer tube diameter, and is retained with button head socket screws positioned on an outside surface of each extending leg, said butt plate assembly includes a plate with a number of attaching countersunk bores, a threaded rod has a first end and a second end where the first end of the threaded rod is vertically flat and the second end of the threaded rod is angled from 3 degrees to 1 degree, each end of the threaded rod having a number of threaded holes for mating with the countersunk bores of the plate such that the threaded rod can be either positioned within the buffered tube flat or angled relative to the plate, and wherein the butt plate assembly is attached to a selected end of the threaded rod with flat head cap screws through the countersunk holes, and a retaining nut locks the threaded rod to the buffer tube, wherein the retaining nut has a plurality of round cavities on an outside surface for tightening with a spanner, wherein when the butt plate assembly is attached into the buffer tube along with the retaining nut the buttstock length may be adjusted and the butt plate assembly orientation in angle and position may be established.

2. An AR type buttstock assembly comprising:

a buffer tube having a first end and a second end with the first end having external threads of a configuration compatible with an AR type firearm, and the second end having internal threads of a configuration compatible with a butt plate assembly, said buffer tube containing a threaded recoil buffer disc that defines edges and having disc threads on the edges that interface with the second end internal threads, said buffer disc defining a tool slot for receiving a conventional screwdriver, a U-shaped cheek piece having opposed extending legs that are attached to the buffer tube in an adjustable manner permitting a user to rest its cheek in a comfortable position when sighting a firearm, and wherein the cheek piece incorporates at least one slot on each extending leg to receive threaded fasteners such that the threaded fasteners extend through the opposed extending legs for gripping the buffer tube rigidly, said threaded fasteners include a hand knob that provides a manual positioning of the cheek piece parallel, upward or tilted relative to the buffer tube and longitude angularly providing limited cast on and cast off features, a mounting block having a radial top and a width compatible with a span between the extending legs slots and the same diameter as the buffer tube permitting rigid attachment to the buffer tube, said mounting block is retained with a button head socket set screw, said butt plate assembly consists of a plate with a number of attaching countersunk bores, a threaded rod having a first end and a second end where the first end of the threader rod is flat and the second end of the threaded rod is angled from 3 degrees to 1 degree, each end of the threaded rod having a number of threaded holes for mating with the countersunk bores of the plate such that the threaded rod can be either positioned within the buffer tube flat or angled relative to the plate, and wherein the butt plate assembly is attached to a selected end of the threaded rod with flat head cap screws through the countersunk holes, and a retaining nut locks the threaded rod to the buffer tube, wherein the retaining nut has a plurality of round cavities on an outside surface for tightening with a spanner, wherein when the butt plate assembly is attached into the buffer tube along with the retaining nut the overall buttstock length may be adjusted and the butt plate assembly orientation in angle and position may be established.

3. An AR type buttstock assembly comprising:

a buffer tube having a first end and a second end with the first end having external threads of a configuration compatible with an AR type firearm, and the second end having internal threads of a configuration compatible with a butt plate assembly, said buffer tube further defining a knurled portion positioned where contact is made with a U-shaped cheek piece, wherein said U-shaped cheek piece having opposed extending legs that are attached to the buffer tube in an adjustable manner permitting a user to rest its cheek in a comfortable position when sighting a firearm, a spacing member is disposed between the opposed extending legs of the cheek piece to maintain constant tension between the buffer tube and the cheek piece, said butt plate assembly includes a plate with a number of attaching countersunk bores, wherein when the butt plate assembly is attached in to the buffer tube along with a retaining nut the overall buttstock length may be adjusted and the butt plate assembly orientation in angle and position may be established.

4. The assembly of claim 3, wherein said buffer tube including a threaded recoil buffer disc having disc threads on the buffer disc's edges that interface with the second end internal threads, said buffer disc defining a tool slot for receiving a conventional screwdriver.

5. The assembly of claim 3, wherein said cheek piece incorporates at least one slot on each extending leg to receive at least one threaded fastener, and further utilizes a clearance hole in each extending leg to accommodate a spacer such that the at least one threaded fastener extends through the opposed extending legs for gripping the buffer tube rigidly.

6. The assembly of claim 5, wherein said at least one threaded fastener includes a hand knob providing manual positioning of the cheek piece parallel, upward or tilted relative to the buffer tube and longitude angularly providing limited cast on and cast off features.

7. The assembly of claim 3, wherein said spacing member is a spanning spacer that is internally threaded and has on overall length consistent with the buffer tube diameter, and is retained with button head socket screws positioned on an outside surface of each extending leg.

8. The assembly of claim 3, wherein said spacing member is a mounting block having a radial top and a width compatible with a span between the extending legs slots and having the same diameter as the buffer tube permitting rigid attachment to the buffer tube, said mounting block is retained with a button head socket set screw.

* * * * *